US011411299B2

(12) United States Patent
Kim et al.

(10) Patent No.: US 11,411,299 B2
(45) Date of Patent: Aug. 9, 2022

(54) FILM ANTENNA AND DISPLAY DEVICE INCLUDING THE SAME

(71) Applicants: DONGWOO FINE-CHEM CO., LTD., Jeollabuk-do (KR); KREEMO INC., Seoul (KR)

(72) Inventors: Jong Min Kim, Gyeonggi-do (KR); Han sub Ryu, Gyeongsangbuk-do (KR); Dong Pil Park, Incheon (KR); Won Bin Hong, Seoul (KR)

(73) Assignees: DONGWOO FINE-CHEM CO., LTD., Jeollabuk-Do (KR); KREEMO INC., Seoul (KR)

( * ) Notice: Subject to any disclaimer, the term of this patent is extended or adjusted under 35 U.S.C. 154(b) by 0 days.

(21) Appl. No.: 16/865,654

(22) Filed: May 4, 2020

(65) Prior Publication Data

US 2020/0266525 A1 Aug. 20, 2020

Related U.S. Application Data

(63) Continuation of application No. PCT/KR2018/013340, filed on Nov. 6, 2018.

(30) Foreign Application Priority Data

Nov. 6, 2017 (KR) ..... 10-2017-0146873

(51) Int. Cl.
*H01Q 1/22* (2006.01)
*H01Q 1/38* (2006.01)
(Continued)

(52) U.S. Cl.
CPC ..... *H01Q 1/243* (2013.01); *H01Q 1/38* (2013.01); *H01Q 5/307* (2015.01); *H01Q 9/0407* (2013.01)

(58) Field of Classification Search
CPC .. H01Q 1/32; H01Q 1/38; H01Q 1/44; H01Q 1/24; H01Q 5/00; H01Q 9/04;
(Continued)

(56) References Cited

U.S. PATENT DOCUMENTS 5,422,649 A * 6/1995 Huang ..... H01Q 13/206 343/700 MS
6,359,588 B1 * 3/2002 Kuntzsch ..... H01Q 9/0407 343/700 MS
(Continued)

FOREIGN PATENT DOCUMENTS

CN 106104915 A 11/2016
JP S59-126304 A 7/1984
(Continued)

OTHER PUBLICATIONS

International Search Report for PCT/KR2018/013340 dated Mar. 5, 2019.
(Continued)

*Primary Examiner* — Blane J Jackson
(74) *Attorney, Agent, or Firm* — The PL Law Group, PLLC

(57) ABSTRACT

A film antenna according to an embodiment of the present invention includes a dielectric layer, and a plurality of radiation patterns on a top surface of the dielectric layer. The plurality of radiation patterns has different resonance frequencies on the same plane. The radiation patterns of different frequency bands are arranged in the film antenna to provide a broadband communication.

10 Claims, 5 Drawing Sheets

(51) Int. Cl.
*H01Q 1/24* (2006.01)
*H01Q 5/307* (2015.01)
*H01Q 9/04* (2006.01)

(58) Field of Classification Search
CPC ..... H01Q 21/38; H01Q 1/22; H01Q 1/241; H04B 7/02; H04B 7/04; H04B 7/0404
See application file for complete search history.

(56) References Cited

U.S. PATENT DOCUMENTS

| | | | | |
|---|---|---|---|---|
| 9,537,216 | B1 * | 1/2017 | Kontopidis | H01Q 3/26 |
| 2014/0106684 | A1 * | 4/2014 | Burns | H01Q 21/28 455/78 |
| 2014/0218259 | A1 | 8/2014 | Lee et al. | |
| 2016/0359238 | A1 * | 12/2016 | Okunaga | H01P 5/12 |
| 2020/0251814 | A1 * | 8/2020 | Ryu | H01Q 9/0407 |

FOREIGN PATENT DOCUMENTS

| | | | | | |
|---|---|---|---|---|---|
| JP | H04-135007 | U | | 12/1992 | |
| JP | 2003-198230 | A | | 7/2003 | |
| JP | 2004-112397 | A | | 4/2004 | |
| JP | 2004112397 | A | * | 4/2004 | H01Q 21/30 |
| JP | 2005-244317 | A | | 9/2005 | |
| JP | 2007-274528 | A | | 10/2007 | |
| JP | 2017-175540 | A | | 9/2017 | |
| KR | 10-2003-0095557 | A | | 12/2003 | |
| KR | 10-0920018 | B1 | | 10/2009 | |
| KR | 10-1744886 | B1 | | 6/2017 | |
| WO | WO 2011/089219 | A1 | | 7/2011 | |

OTHER PUBLICATIONS

Office action dated Jun. 1, 2021 from Japan Intellectual Property Office in a counterpart Japanese Patent Application No. 2020-543447 (all the cited references are listed in this IDS.) (English translation is also submitted herewith.).

Notice of Allowance dated Nov. 24, 2021 from Japan Intellectual Property Office in a counterpart Japanese Patent Application No. 2020-543447 (all the cited references are listed in this IDS.) (English translation is also submitted herewith.).

* cited by examiner

FILM ANTENNA AND DISPLAY DEVICE INCLUDING THE SAME

CROSS REFERENCE TO RELATED APPLICATIONS AND CLAIM OF PRIORITY

The present application is a continuation application to International Application No. PCT/KR2018/013340 with an International Filing Date of Nov. 6, 2018, which claims the benefit of Korean Patent Application No. 10-2017-0146873 filed on Nov. 6, 2017 at the Korean Intellectual Property Office, the disclosures of which are incorporated by reference herein in their entirety.

BACKGROUND

1. Field

The present invention relates to a film antenna and a display device including the same. More particularly, the present invention relates to a film antenna including an electrode and a dielectric layer and a display device including the same.

2. Description of the Related Art

As information technologies have been developed, a wireless communication technology such as Wi-Fi, Bluetooth, etc., is combined with a display device in, e.g., a smartphone form. In this case, an antenna may be combined with the display device to provide a communication function.

As mobile communication technologies have been developed recently, an antenna for a communication of a high-frequency or ultra-high frequency band is required in the display device.

For example, in a high frequency communication of a recent 5G, as a wavelength becomes shorter, a signal transmission/reception may be blocked. Further, a frequency band capable of the signal transmission/reception may become narrower to easily cause signal loss and signal blocking.

Further, as the display device to which the antenna is applied becomes thinner and lighter, a space for the antenna may also become smaller. Accordingly, a high-frequency and broadband communication may not be easily implemented in the limited space.

SUMMARY

According to an aspect of the present invention, there is provided a film antenna having improved signaling efficiency.

According to an aspect of the present invention, there is provided a display device including a film antenna with improved signaling efficiency.

The above aspects of the present invention will be achieved by one or more of the following features or constructions:

(1) A film antenna, including: a dielectric layer; and a plurality of radiation elements each having a pattern on a top surface of the dielectric layer, the plurality of radiation elements having different resonance frequencies on the same plane.

(2) The film antenna according to the above (1), wherein the plurality of radiation elements include a first element pattern, a second radiation element and a third radiation element which are sequentially arranged along one direction parallel to the top surface of the dielectric layer, and the first radiation element, the second radiation element and the third radiation element have different resonance frequencies.

(3) The film antenna according to the above (2), wherein resonance frequencies of the first radiation element, the second radiation element and the third radiation element sequentially increase.

(4) The film antenna according to the above (3), wherein lengths of the first radiation element, the second radiation element and the third radiation element sequentially decrease.

(5) The film antenna according to the above (4), wherein a difference between a length of the first radiation element and a length of the second radiation element, and a difference between the length of the second radiation element and a length of the third radiation element are each from 0.01 mm to 5 cm.

(6) The film antenna according to the above (2), wherein the first radiation element includes a plurality of first radiation elements to form a first radiation group, the second radiation element includes a plurality of second radiation elements to form a second radiation group, and the third radiation element includes a plurality of third radiation elements to form a third radiation group.

(7) The film antenna according to the above (1), wherein a distance between centers of neighboring radiation elements having different resonance frequencies of the plurality of radiation elements is greater than or equal to half a minimum wavelength corresponding to a resonance frequency of the film antenna.

(8) The film antenna according to the above (1), wherein an entire resonance frequency of the film antenna is in a range from 3 GHz to 70 GHz.

(9) The film antenna according to the above (1), further including a ground layer on a bottom surface of the dielectric layer.

(10) The film antenna according to the above (1), further including: a transmission line extending from each of the plurality of the radiation elements; and a pad electrically connected to a radiation element having a corresponding resonance frequency of the plurality of the radiation elements via the transmission line.

(11) The film antenna according to the above (1), further including a dummy element formed around the plurality of radiation elements.

(12) The film antenna according to the above (11), wherein the plurality of radiation elements and the dummy element include a mesh-pattern structure.

(13) A display device including the film antenna according to embodiments as described above.

In the film antenna according to embodiments of the present invention, a plurality of radiation elements having different resonance frequencies may be arranged at the same level or on the same plane. Thus, a broadband signal transmission/reception may be implemented in a substantial single film.

In some embodiments, a plurality of radiation elements of each resonance frequency may form a group, and a plurality of the group may be included as an array form in a single film. Thus, a signaling sensitivity may be enhanced while implementing the broadband signal transmission/reception.

The film antenna may be applied to a display device including a mobile communication device capable of transmitting/receiving at high-frequency or ultra-high frequency bands of 3G, 4G, 5G or more to improve radiation properties and optical properties such as a transmittance.

DETAILED DESCRIPTION OF THE EMBODIMENTS

According to exemplary embodiments of the present invention, there is provided a film antenna including radiation elements each having a pattern being arranged at the same level or on the same plane and having different resonance frequencies to provide a broadband signal transmission/reception.

The film antenna may be, e.g., a microstrip patch antenna fabricated as a transparent film. The film antenna may be applied to a communication device for high or ultra-high frequency band (e.g., 3G, 4G, 5G or more) mobile communications.

According to exemplary embodiments of the present invention, there is provided a display device including the film antenna. The film antenna may be also applied to various devices or objects such as an automobile, a home electronic device, an architecture, etc.

Hereinafter, the present invention will be described in detail with reference to the accompanying drawings. However, those skilled in the art will appreciate that such embodiments described with reference to the accompanying drawings are provided to further understand the spirit of the present invention and do not limit subject matters to be protected as disclosed in the detailed description and appended claims.

Figure 1:
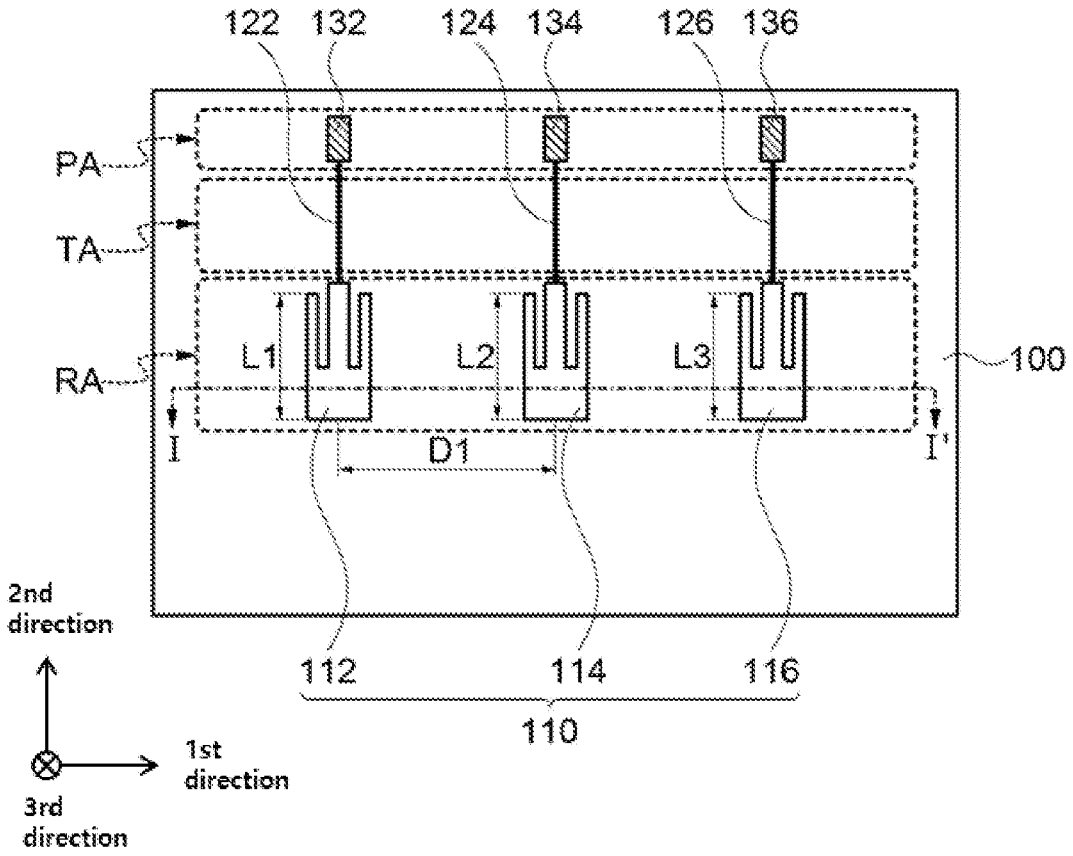
FIGS. 1 and 2 are a schematic top planar view and a schematic cross-sectional view, respectively, illustrating a film antenna in accordance with exemplary embodiments.
Figure 2:
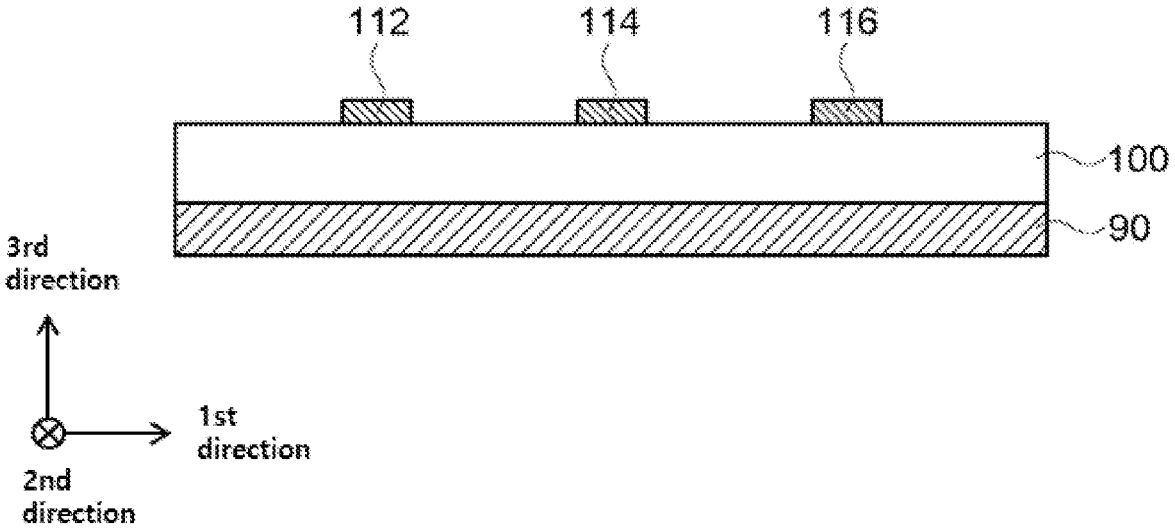

FIGS. 1 and 2 are a schematic top planar view and a schematic cross-sectional view, respectively, illustrating a film antenna in accordance with exemplary embodiments. For example, FIG. 2 is a cross-sectional view taken along a line I-I' of FIG. 1.

In FIG. 1, two directions parallel to a top upper surface of the dielectric layer 100 and perpendicular to each other are defined as a first direction and a second direction, and a direction vertical to the first and second directions is defined as a third direction. For example, the first, second, and third directions may correspond to X-axis, Y-axis, and Z-axis directions, respectively. The definition of the above-described directions may be applied to all accompanying drawings.

Referring to FIG. 1, a film antenna according to exemplary embodiments includes a dielectric layer 100 and radiation elements 110 each having a pattern.

The dielectric layer 100 may include an insulating material having a predetermined dielectric constant. The dielectric layer 100 may include, e.g., an inorganic insulating material such as glass, silicon oxide, silicon nitride and a metal oxide, etc., or an organic insulating material such as an epoxy resin, an acryl resin, an imide-based resin, etc. The dielectric layer 100 may serve as a film substrate of the film antenna for forming the radiation elements 110.

The dielectric layer 100 may include a transparent film. For example, the transparent film may include, e.g., a polyester-based resin such as polyethylene terephthalate, polyethylene isophthalate, polyethylene naphthalate, polybutylene terephthalate, etc.; a cellulose-based resin such as diacetyl cellulose, triacetyl cellulose, etc.; a polycarbonate-based resin; an acryl-based resin such as polymethyl (meth) acrylate, polyethyl (meth)acrylate, etc.; a styrene-based resin such as polystyrene, an acrylonitrile-styrene copolymer; a polyolefin-based resin such as polyethylene, polypropylene, a polyolefin having a cyclo or norbornene structure, etc.; a vinyl chloride-based resin; an amide-based resin such as nylon, an aromatic polyamide, etc.; an imide-based resin; a polyether sulfone-based resin; a sulfone-based resin; a polyether ketone-based resin; a polyphenylene sulfide-based resin; a vinyl alcohol-based resin; a vinylidene chloride-based resin; a vinyl butyral-based resin; an allylate-based resin; a polyoxymethylene-based resin; an epoxy-based resin; a urethane or acryl urethane-based resin; a silicone-based resin, etc. These may be used alone or in a combination thereof.

In some embodiments, the dielectric layer 100 may include an adhesive film including a pressure-sensitive adhesive (PSA) or an optically clear adhesive (OCA).

In some embodiments, a dielectric constant of the dielectric layer 100 may be in a range from about 1.5 to about 12. If the dielectric constant exceeds about 12, a driving frequency may be excessively decreased and a desired high-frequency radiation may not be implemented.

In exemplary embodiments, the film antenna may include a pad area PA, a transmission area TA and a radiation area RA. Accordingly, the dielectric layer 100 may also be divided into the pad area PA, the transmission area TA, and the radiation area RA.

In exemplary embodiments, a plurality of the radiation elements 110 may be arranged together on a top surface of the dielectric layer 100. In exemplary embodiments, the radiation elements 110 may be arranged along the first direction together at the same level or on the same plane. For example, the radiation elements 110 may be arranged on a top surface of a portion of the dielectric layer 100 in the radiation area RA.

As illustrated in FIG. 1, 1, each radiation element 110 may include a protrusion connected to a transmission line 122, 124 and 126 in a central portion thereof. However, the shape of the radiation element 110 may be appropriately changed from an example of FIG. 1 in consideration of radiation efficiency or the like.

In exemplary embodiments, the radiation elements 110 may have different resonance frequencies. For example, the radiation elements 110 may include a first radiation element 112, a second radiation element 114 and a third radiation element 116 that may be sequentially arranged along the first direction while having different resonance frequencies.

In some embodiments, the resonance frequencies may be sequentially increased in an order of the first radiation element 112, the second radiation element 114 and the third radiation element 116. In some embodiments, a difference between the neighboring radiation elements may be about 1 GHz or less.

For example, the first radiation element 112 may have a resonance frequency from about 26 GHz to about 27 GHz, the second radiation element 114 may have a resonance frequency from about 27 GHz to about 28 GHz, and the third radiation element 116 may have a resonance frequency from about 28 GHz to about 29 GHz. Accordingly, the film antenna may have coverage in a range from about 26 GHz to about 29 GHz.

However, the resonance frequency of each radiation element 110 may be adjusted in consideration of a total resonance frequency coverage of the film antenna, and the number of radiation elements 110 may also be adjusted according to the coverage.

In some embodiments, the total resonant frequency coverage of the film antenna may be from about 3 GHz to about 70 GHz to cover a communication corresponding to 5G or more, and in an embodiment, from about 25 GHz to about 35 GHz.

As described above, when the resonance frequency increases in an order of the first radiation element 112, the second radiation element 114 and the third radiation element 116, lengths (e.g., lengths in the second direction) of the radiation elements may decrease in an order of the first radiation element 112, the second radiation element 114 and the third radiation element 116.

As illustrated in FIG. 1, the length of the first radiation element 112 is indicated by "L1", the length of the second radiation element 114 is indicated by "L2", and the length of the third radiation element may be indicated as "L3". The lengths may decrease in an order of L1, L2 and L3.

In an embodiment, a length difference between the neighboring radiation elements 110 (e.g., L1–L2 and L2–L3) may be in a range from about 0.01 mm to about 5 cm so that the resonance frequencies may overlap each other.

The length L1, L2 and L3 of each radiation element 110 may be adjusted, e.g., in a range of about 0.5 mm to 10 cm for implementing a signal transmission and reception of the above-mentioned 5G or more communication.

In some embodiments, the resonance frequencies may decrease in an order of the first radiation element 112, the second radiation element 114 and the third radiation element 116, and the lengths may increase in the order. As described above, the radiation elements may be arranged so that the resonance frequencies may sequentially increase or decrease to enhance an overlapping efficiency of the resonance frequencies.

However, the arrangement order of the first radiation element 112, the second radiation element 114 and the third radiation element 116 may be randomly adjusted, and is not specifically limited.

A distance D1 between the neighboring radiation elements 110 may be adjusted so that independent radiation and polarization property of each radiation element 110 may be achieved. The distance D1 between the neighboring radiation elements 110 may be defined as a distance between centers of the neighboring radiation elements 110 (the radiation elements having different resonance frequencies). For example, the distance D1 may be defined as a distance between a center of the first radiation element 112 and a center of the second radiation element 114, and a distance between a center of the second radiation element 114 and a center of the third radiation element 116.

In some embodiments, the distance D1 between the neighboring radiation elements 110 may be half a minimum wavelength corresponding to the resonance frequency of the film antenna ($\lambda/2$) or more, and in an embodiment, $\lambda$ or more.

The radiation element 110 may include silver (Ag), gold (Au), copper (Cu), aluminum (Al), platinum (Pt), palladium (Pd), chromium (Cr), titanium (Ti), tungsten (W), niobium (Nb), tantalum (Ta), vanadium (V), iron (Fe), manganese (Mn), cobalt (Co), nickel (Ni), zinc (Zn), tin (Sn), molybdenum (Mo), calcium (Ca) or an alloy thereof. These may be used alone or in combination thereof. For example, the antenna element may be formed of silver (Ag) or a silver alloy (e.g., silver-palladium-copper (APC) alloy), or copper or a copper alloy (e.g., a copper-calcium (CuCa) alloy) for implementing a low resistance and a fine line width.

The radiation element 110 may include a transparent metal oxide such as indium tin oxide (ITO), indium zinc oxide (IZO), indium zinc tin oxide (IZTO), zinc oxide (ZnOx), etc.

For example, the radiation element 110 may have a multi-layered structure including a metal layer or alloy layer and a transparent metal oxide layer. In some embodiments, the radiation element 110 may have a mesh-pattern structure to have improved transmittance.

In some embodiments, the radiation element 110 may have a metal thin film structure of high transmittance. For example, the radiation element 110 may have a solid metal thin film structure of a thickness from about 50 Å to about 200 Å. For example, the transmittance of the radiation element 110 may be about 70% or more, preferably about 80% or more.

The transmission lines 122, 124 and 126 may be disposed on a portion of the dielectric layer 100 of the transmission area TA to be connected to the radiation elements 110. In exemplary embodiments, the first transmission line 122, the second transmission line 124 and the third transmission line 126 may be connected to the first radiation element 112, the second radiation element 114 and the third radiation element 116, respectively. For example, one ends of the transmission lines 122, 124 and 126 may be connected to each radiation element 110.

The transmission lines 122, 124, and 126 may include a conductive material substantially the same as that of the radiation element 110, and may be formed together with the radiation element 110 by the same etching process. In exemplary embodiments, the transmission lines 122, 124 and 126 and the radiation element 110 may be formed on the top surface of the dielectric layer 100 to form a conductive layer at the same level.

The transmission lines 122, 124 and 126 may extend to the pad area PA and may be electrically connected to pads 132, 134 and 136. For example, the first transmission line 122 may extend from the first pad 132 to be electrically connected to the first radiation element 112. The second transmission line 124 may extend from the second pad 134 to be electrically connected to the second radiation element 114. The third transmission line 126 may extend from the third pad 136 to be electrically connected to the third radiation element 116.

In some embodiments, the pads 132, 134, 136 may be disposed on the same layer or at the same plane as that of the transmission lines 122, 124, 126 and the radiation elements 110. In some embodiments, the pads 132, 134, 136 may be formed on an upper level of the transmission lines 122, 124, 126. For example, an insulating layer (not illustrated) covering the transmission lines 122, 124, and 126 may be formed on the dielectric layer 100, and the pads 132, 134, and 136 may be formed on the insulating layer. For example, the pads 132, 134, and 136 may be electrically connected to the transmission lines 122, 124, and 126 through vias or contacts penetrating the insulating layer.

Referring to FIG. 2, a ground layer 90 may be formed on a bottom surface of the dielectric layer 100. For example, a capacitance or inductance may be created in the third direction between the radiation elements 112, 114, and 116 and the ground layer 90 by the dielectric layer 100 so that a frequency band for an antenna driving or an antenna sensing may be adjusted. For example, the film antenna may be provided as a vertical radiation antenna.

The ground layer 90 may include a conductive material such as a metal, an alloy or a transparent metal oxide. In an embodiment, a conductive member of a display device to which the film antenna is applied may serve as the ground layer.

The conductive member may include a gate electrode of a thin film transistor (TFT), various wirings such as a scan line or a data line, various electrodes such as a pixel electrode, a common electrode, etc., included in a display panel.

As described above, a plurality of the radiation elements 110 having different resonance frequencies may be arranged in, e.g., a parallel arrangement as a single film antenna. Accordingly, a bandwidth of the frequency that may be sensed through the film antenna may be expanded.

Figure 3:
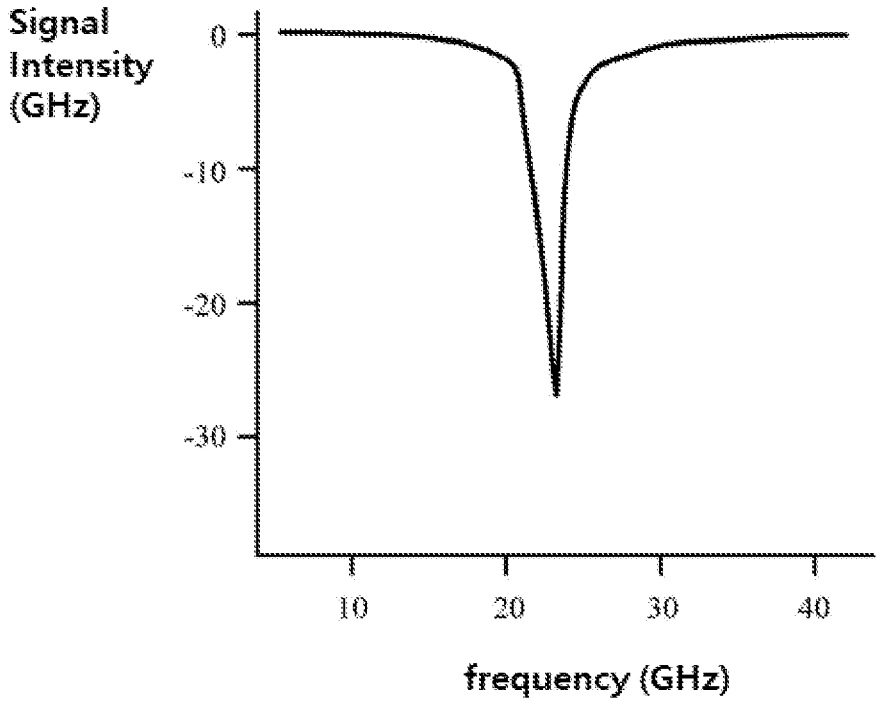
FIG. 3 is a graph showing a resonance frequency of a film antenna in accordance with a comparative example.

FIG. 3 is a graph showing a resonance frequency of a film antenna in accordance with a comparative example.

Referring to FIG. 3, for example, a bandwidth capable of transmitting and receiving may be reduced due to a low power, etc., in the case of a patch-type film antenna. Accordingly, a width of a peak corresponding to the resonance frequency is excessively reduced, so that signal blocking may occur. Further, as the bandwidth decreases, a channel capacity decreases, and thus a signal transmission/reception speed may also decrease.

Figure 4:
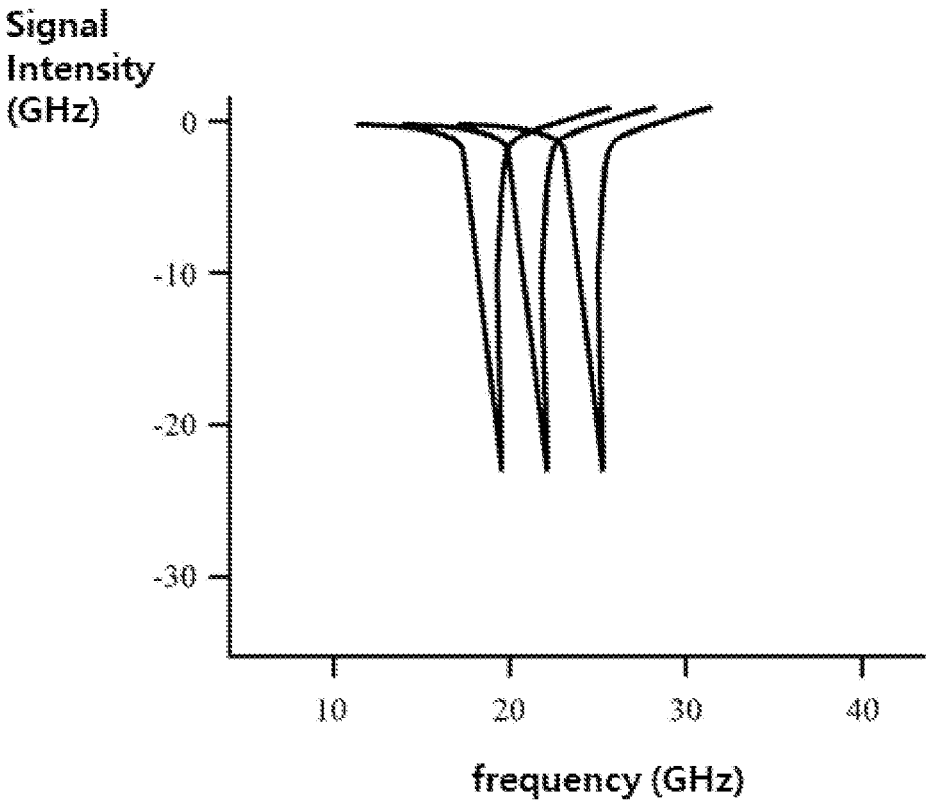
FIG. 4 is a graph showing a resonance frequency of a film antenna in accordance with exemplary embodiments.

FIG. 4 is a graph showing a resonance frequency of a film antenna in accordance with exemplary embodiments.

Referring to FIG. 4, in the case of a film antenna according to exemplary embodiments, the radiation elements 110 having different resonance frequencies may be arranged in parallel so that an overlap of each bandwidth may occur.

Thus, a broadband communication through the bandwidth overlapping may be implemented while obtaining a high-frequency transmission/reception of each radiation element 110. Additionally, the antenna may be provided as a patch film having a relatively small thickness so that signal loss may also be remarkably reduced.

Figure 5:
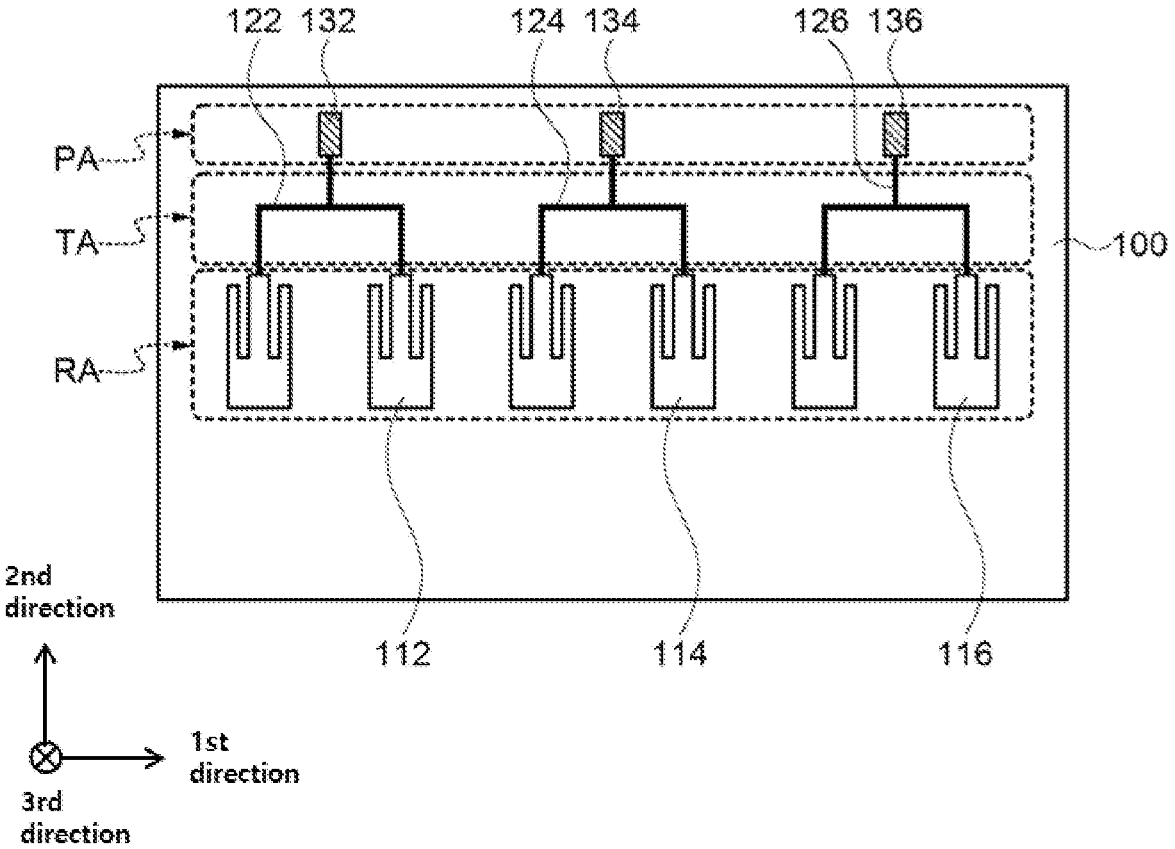
FIG. 5 is a schematic top planar view illustrating a film antenna in accordance with some exemplary embodiments.

FIG. 5 is a schematic top planar view illustrating a film antenna in accordance with some exemplary embodiments.

Referring to FIG. 5, a plurality of the first radiation elements 112, a plurality of the second radiation elements 114, and a plurality of the third radiation elements 116 may be arranged to form radiation groups.

For example, as illustrated in FIG. 5, a pair of the first radiation elements 112 may be coupled by the first transmission line 122 to define a first radiation group. A pair of second radiation elements 114 may be coupled by the second transmission line 124 to define a second radiation group. A pair of the third radiation elements 116 may be coupled by the third transmission line 126 to define a third radiation group.

A plurality of the radiation elements of each resonance frequency may be paired so that a density of the radiation elements may be increased, and efficiency of signal transmission/reception may be further improved. Additionally, gain or sensitivity for a corresponding resonance frequency of each radiation element may be increased. Accordingly, a broadband communication with high power and high frequency may be realized through the film antenna.

In some embodiments, a spacing distance between the radiation groups (e.g., the distance between the centers of two neighboring radiation elements included in different radiation groups) may be about $\lambda/2$ or more, and in an embodiment, $\lambda$ or more.

FIG. 5 illustrates that each radiation group has a 1*2 construction. However, the construction of the radiation group may be properly modified as, e.g., 1*3 or 1*4 constructions, etc., in consideration of a size, a communication band or the like of an electronic device to which the film antenna is applied.

Figure 6:
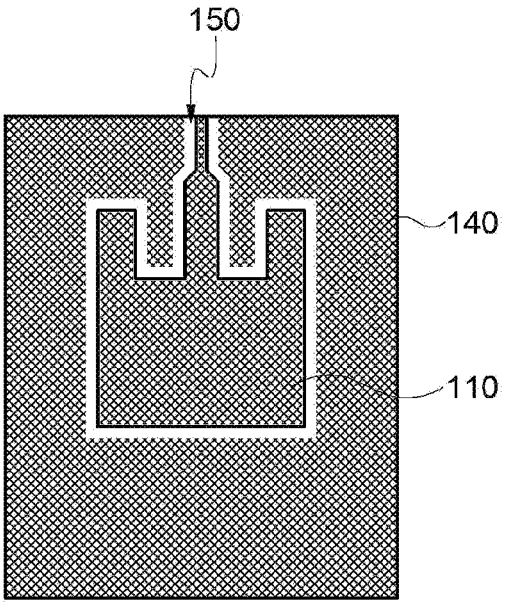
FIG. 6 is a schematic top planar view illustrating a pattern structure of a film antenna in accordance with some exemplary embodiments.

FIG. 6 is a schematic top planar view illustrating a pattern structure of a film antenna in accordance with some exemplary embodiments.

Referring to FIG. 6, a dummy element 140 having a mesh-pattern structure may be formed around the radiation element 110. In an embodiment, the radiation element 110 may also include a mesh-pattern structure substantially the same as or similar to that of the dummy element 140.

For example, the radiation element 110 and the dummy element 140 may be separated and insulated from each other by a separation region 150 formed along a boundary of the radiation elements 110.

The radiation elements 110 and the dummy element 140 may be formed of substantially the same or similar mesh-pattern structure so that visibility of the radiation element 110 due to a pattern shape deviation may be prevented while improving transmittance of the film antenna.

Figure 7:
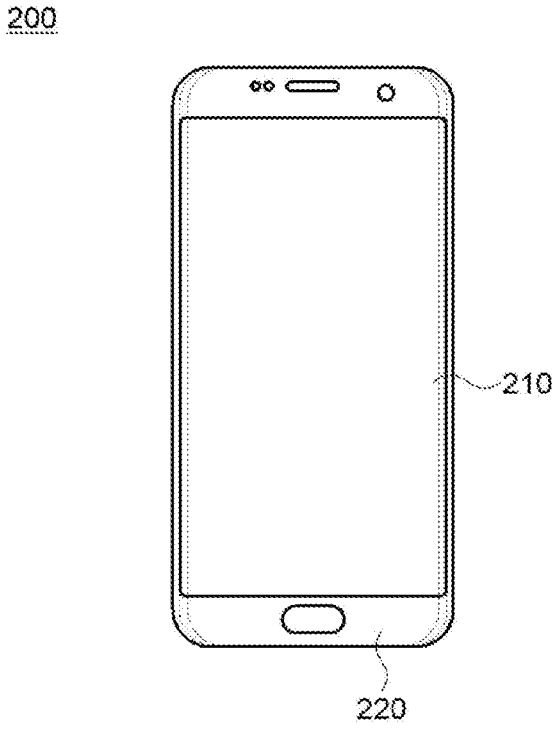
FIG. 7 is a schematic top planar view illustrating a display device in accordance with exemplary embodiments.

FIG. 7 is a schematic top planar view illustrating a display device in accordance with exemplary embodiments. For example, FIG. 7 illustrates an outer shape including a window of a display device.

Referring to FIG. 7, a display device 200 may include a display region 210 and a peripheral region 220. The peripheral region 220 may be positioned, e.g., at both lateral portions and/or both end portions of the display region 210.

In some embodiments, the above-described film antenna may be inserted in the display device 200 as a patch. In some embodiments, the radiation area RA of the film antenna as described with reference to FIG. 1 may at least partially correspond to the display region 210 of the display device 200, and the pad area PA may be disposed to correspond to the peripheral region 220.

The peripheral region 220 may correspond to, e.g., a light-shielding portion or a bezel portion of the image display device. Additionally, a driving circuit such as an IC chip of the display device 200 and/or the film antenna may be disposed in the peripheral region 220.

The pad area PA of the film antenna may be positioned to be adjacent to the driving circuit so that signal transmission/reception path may become shorter to suppress signal loss.

In some embodiments, the dummy element 140 (see FIG. 6) of the film antenna may be disposed in the display region 210. Accordingly, reduction of transmittance in the display region 210 and electrode visibility of the film antenna may be prevented.

What is claimed is:

1. A film antenna, comprising:

a dielectric layer;

a plurality of radiation elements each having a pattern, the plurality of radiation elements on a top surface of the dielectric layer, the plurality of radiation elements having different resonance frequencies on the same plane, a transmission line extending from each of the plurality of the radiation elements; and pads electrically connected to the plurality of the radiation elements, respectively, via the transmission line, the pads each being connected to an end of the transmission line, a dummy element formed around the plurality of the radiation elements, the dummy element being separated and insulated from the plurality of the radiation elements, wherein the plurality of the radiation elements, the transmission line and the pads are disposed at the same level, and the plurality of the radiation elements, the transmission line and the pads are disposed only on a top surface of the dielectric layer; and the plurality of radiation elements and the dummy element include a mesh-pattern structure.

2. The film antenna of claim 1, wherein the plurality of radiation elements comprise a first radiation element, a second radiation element and a third radiation element which are sequentially arranged along one direction parallel to the top surface of the dielectric layer; and the first radiation element, the second radiation element and the third radiation element have different resonance frequencies from each other.

3. The film antenna of claim 2, wherein a resonance frequency of the first radiation element, a resonance frequency of the second radiation element and a resonance frequency of the third radiation element sequentially increase.

4. The film antenna of claim 3, wherein a length of the first radiation element, a length of the second radiation element and a length of the third radiation element sequentially decrease.

5. The film antenna of claim 4, wherein a difference between the length of the first radiation element and the length of the second radiation element, and a difference between the length of the second radiation element and the length of the third radiation element are each from 0.01 mm to 5 cm.

6. The film antenna of claim 2, wherein the first radiation element comprises a plurality of first radiation elements to form a first radiation group, the second radiation element comprises a plurality of second radiation elements to form a second radiation group, and the third radiation element comprises a plurality of third radiation elements to form a third radiation group.

7. The film antenna of claim 1, wherein a distance between centers of neighboring radiation elements having different resonance frequencies of the plurality of radiation elements is greater than or equal to half a minimum wavelength corresponding to a resonance frequency of the film antenna.

8. The film antenna of claim 1, wherein an entire resonance frequency of the film antenna is in a range from 3 GHz to 70 GHz.

9. The film antenna of claim 1, further comprising a ground layer on a bottom surface of the dielectric layer.

10. A display device comprising the film antenna of claim 1.

* * * * *